United States Patent [19]

Dean et al.

[11] 4,413,477

[45] Nov. 8, 1983

[54] LINER ASSEMBLY FOR GAS TURBINE COMBUSTOR

[75] Inventors: Gilbert J. Dean, Ballston Spa; Loren H. White, Scotia, both of N.Y.

[73] Assignee: General Electric Company, Schenectady, N.Y.

[21] Appl. No.: 220,272

[22] Filed: Dec. 29, 1980

[51] Int. Cl.[3] ..... F02G 3/00

[52] U.S. Cl. ..... 60/757; 60/39.32

[58] Field of Search ..... 60/322, 39.32, 752, 60/755, 756, 757; 431/352; 138/109, 178, 44

[56] References Cited

U.S. PATENT DOCUMENTS

| | | | |
|---|---|---|---|
| 1,420,217 | 6/1922 | Richards | 138/44 |
| 3,064,425 | 11/1962 | Hayes | 60/756 |
| 3,175,361 | 3/1965 | Schirmer | 60/752 |
| 3,326,041 | 6/1967 | Reed | 138/44 |
| 3,702,058 | 11/1972 | De Corso et al. | 60/757 |

*Primary Examiner*—Carlton R. Croyle
*Assistant Examiner*—Timothy S. Thorpe
*Attorney, Agent, or Firm*—J. C. Squillaro

[57] ABSTRACT

A liner assembly for a combustor used in connection with a gas turbine is disclosed. The liner assembly comprises a double-wall structure including an outer structural shell and a separate throat insert coupled to and situated in the shell. The throat insert has a reduced throat section which divides the outer shell into upstream and downstream chambers. The upstream end of the throat insert is flexibly coupled in a stationary position to the outer shell by integral fingers and the downstream end is flexibly coupled to the outer shell, preferably by an air seal incorporating a plurality of flexible fingers located at the downstream end of the throat insert.

15 Claims, 10 Drawing Figures

LINER ASSEMBLY FOR GAS TURBINE COMBUSTOR

BACKGROUND OF THE INVENTION

The present invention is directed towards an improved combustion liner construction and more specifically to a combustion liner construction including a structural outer shell and a reduced diameter throat insert flexibly coupled thereto.

An improved dual stage-dual mode low NOx combustor is described in co-pending application Ser. No. 56,510 filed July 11, 1979, in the name of Colin Wilkes and Milton B. Hilt, now U.S. Pat. No. 4,292,801 and of common assignee as the present invention. This application discloses a liner assembly including a reduced diameter throat region which divides a gas turbine combustor into first and second combustion chambers. As a result of this division into two chambers, it is possible to control the operation of the combustor to insure that under selected conditions burning takes place in the second chamber only. Such a restriction has been found to reduce the exhaust emissions of the combustor and at the same time prevent flashback from the second chamber into the first chamber. The manner in which these advantages are achieved is described in some detail in the Wilkes application whose disclosure is incorporated herein.

While the combustor of the Wilkes application successfully achieves the foregoing advantages, it has been found that the reduced neck section of the combustor liner are subject to adverse thermal and mechanical stresses which is best overcome by the use of a throat insert in accordance with the present invention. The primary object of the present invention is to provide a new double-wall liner structure which maintains the advantages of the Wilkes application while reducing both the mechanical and thermal stresses placed on the throat section and at the same time simplifying the manner in which the throat section may be replaced.

In accordance with the present invention, the double-wall liner assembly includes an outer structural shell and an inner throat insert flexibly coupled thereto. The throat insert divides the combustor into upstream and downstream combustion chambers for the purposes set forth in the Wilkes patent application. A plurality of fingers are preferably formed about the periphery of the upstream end of the throat insert and are each coupled to the outer shell by a plug weld. The upstream fingers are formed in the throat insert by providing a plurality of axially extending slots about the outer periphery of the upstream portion of the throat insert. In addition to defining the upstream fingers, the slots provide a controlled flow of cooling air from a toroidal space defined between the outer shell and the throat region of the insert into the upstream chamber of the liner. These fingers also provide controlled mount flexibility which diverts liner bending loads from the throat directly into the liner shell so as to lessen throat stresses.

A plurality of axially extending upstream fingers are coupled to the downstream end of the throat insert which provides a slidable, flexible interference-fit coupling between the insert and the outer shell, resulting in a radially loaded coupling. The downstream fingers are preferably, but not necessarily, formed from a single piece of sheet metal which is bent in a circle to form an air seal. The air seal fits around the downstream outer periphery of the throat insert and is preferably coupled thereto by a plurality of spot welds. The flexible fingers are biased against the outer shell of the liner and provide several structural benefits. Initially, the preloading of the fingers insures that they will be biased against the outer shell thereby avoiding joint gaps that otherwise would permit gross, uncontrolled air leakage from the toridal space to the upstream chamber of the liner. The preloading of the fingers further induces Coulomb damping as a means of attenuating throat mechanical vibration induced by normal combustion. Finally, since the fingers form a highly flexible joint between the downstream end of the throat insert and the outer casing, this joint is capable of radical deflection and/or axial motion that is impeded only by the friction between the fingers and the outer shell induced by preloading. As a result, there is a substantial reduction in stresses which are produced by differential thermal expansion between the throat insert and the outer casing. In addition, the sliding connection between the throat insert and the outer casing at the downstream end of the throat insert simplifies the replacement of the insert. Particularly, the insert can be slid out of the outer casing once the plug welds formed at the upstream end of the insert are removed.

BRIEF DESCRIPTION OF THE DRAWINGS

For the purpose of illustrating the invention, there is shown in the drawings an embodiment which is presently preferred, it being understood, however, that the invention is not limited to the precise arrangements and instrumentalities shown.

DETAILED DESCRIPTION OF THE INVENTION

Figure 1:
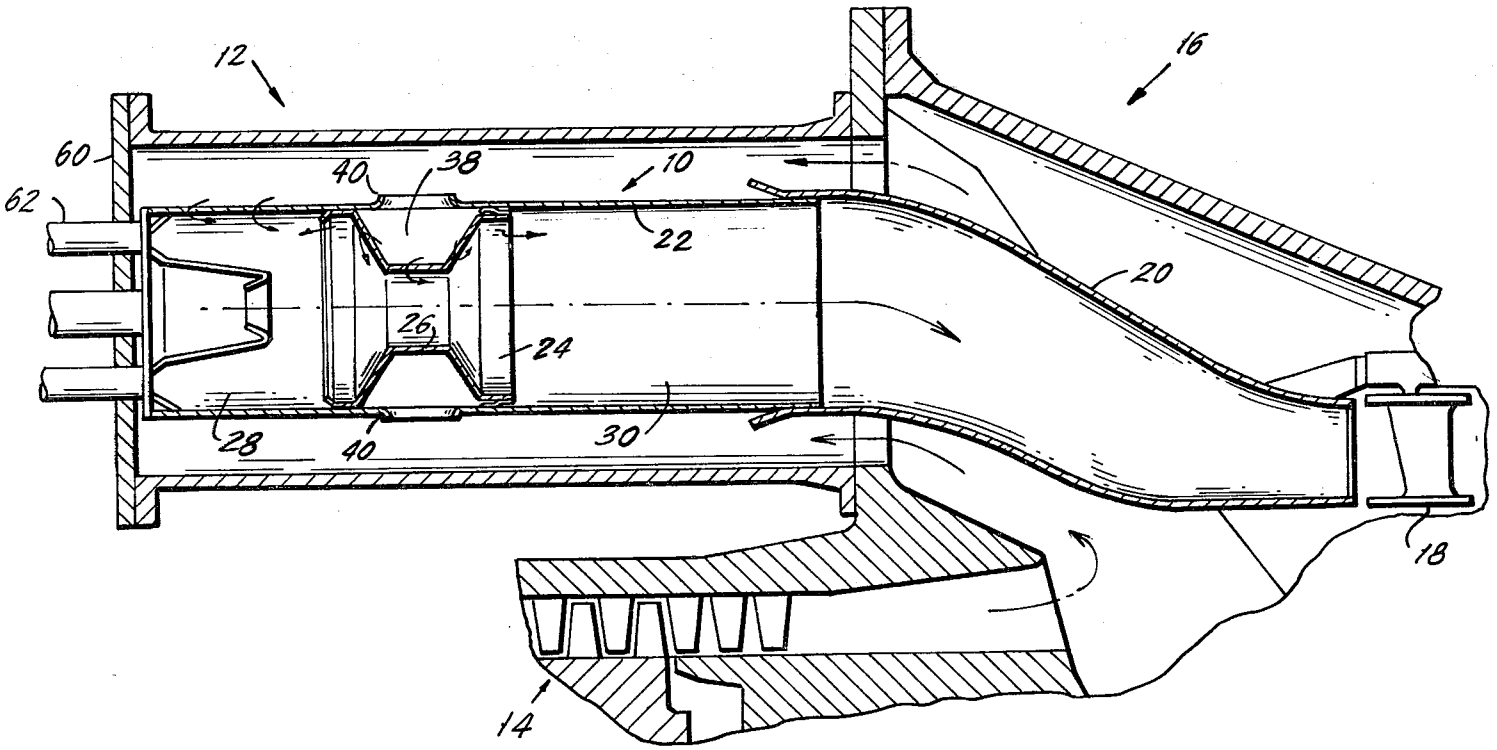
FIG. 1 is a partial cross-sectional view of a gas turbine combustor utilizing the liner assembly of the present invention.

Referring now to the drawings wherein like numerals indicate like elements, there is shown in FIG. 1 a double-wall combustion liner assembly constructed in accordance with the principles of the present invention and designated generally as 10. Combustion liner 10 forms part of a combustor 12 which burns fuel with high pressure air from compressor 14. Both combustor 12 and compressor 14 form part of a combustion turbine 16 whose overall structure need not be described herein. It is sufficient to note that the fuel burned in combustor 12 generates hot gases which are supplied to the first stage nozzle 18 and turbine blades (not shown) via a transition member 20 as the moving force of the turbine.

The double-wall liner assembly 10 includes an air-cooled cylindrical outer shell 22 and an air-cooled liner throat insert 24 located therein. Insert 24 forms a reduced neck section 26 which serves to divide the combustion liner assembly 10 into upstream and downstream chambers 28, 30, respectively. As described in some detail in the Wilkes patent, the use of a reduced neck section 26, in conjunction with certain combustion operation modes, provides lower exhaust emissions. The reduced neck section 26 further reduces the possibility of flashback from the downstream to the upstream chamber. These advantages are discussed in some detail in the Wilkes patent and will not be reviewed herein.

Figure 2:
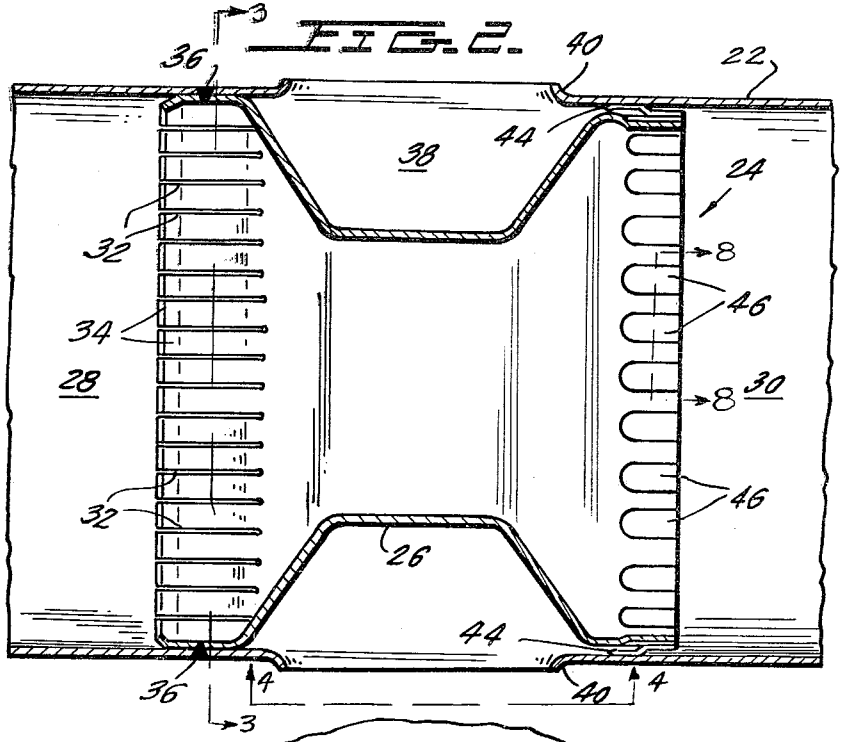
FIG. 2 is a detailed view of the liner assembly of FIG. 1.
Figure 4:
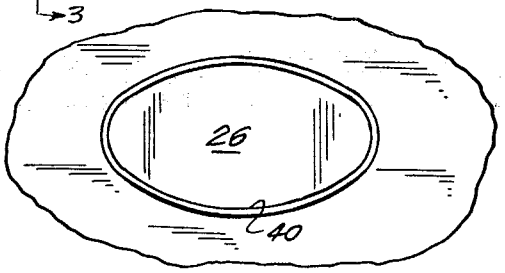
FIG. 4 is a partial bottom view of the liner assembly taken along lines 4—4 of FIG. 2.
Figure 3:
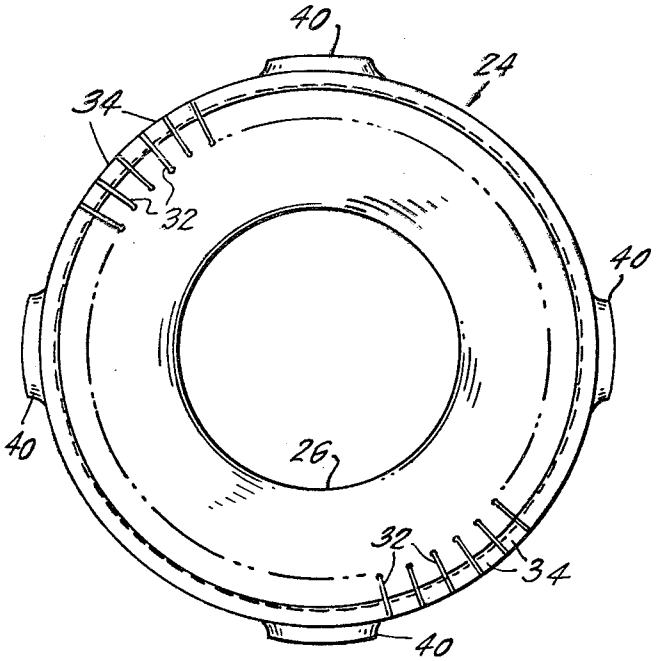
FIG. 3 is a side view of the liner assembly taken along lines 3—3 of FIG. 2.
Figure 6:
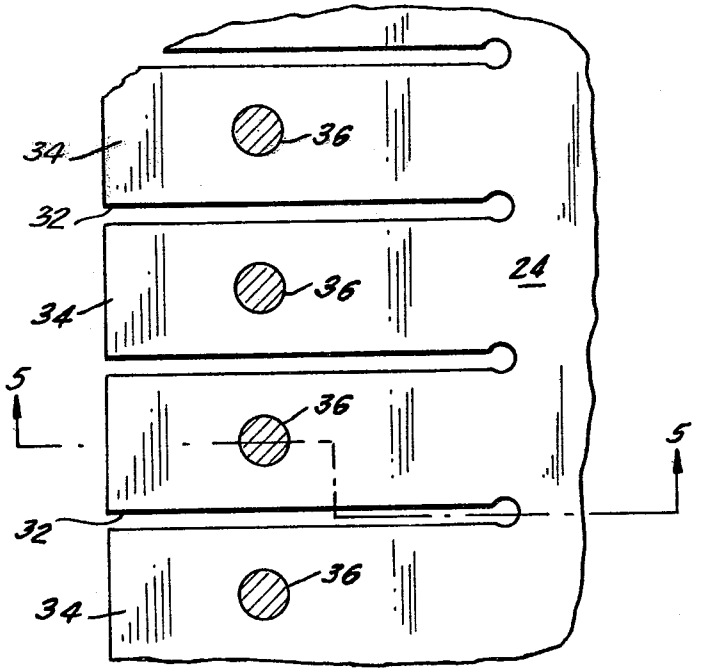
FIG. 6 is a partial detailed view of the upstream portion of the throat insert taken along lines 6—6 of FIG. 5.
Figure 5:
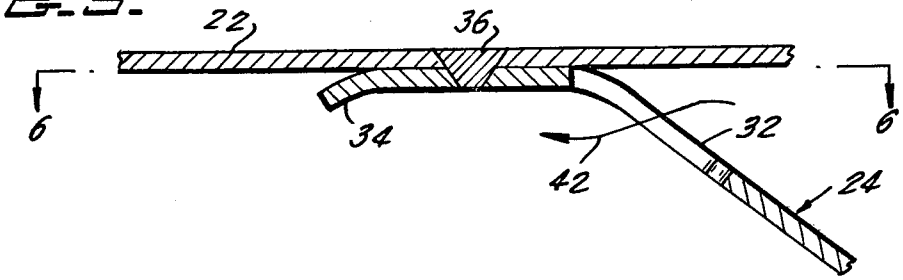
FIG. 5 is a detailed view, partially in cross-section, illustrating the upstream connection between the throat insert and outer shell of the liner assembly of the present invention taken along the lines 5—5 of FIG. 6.

The present invention retains the foregoing advantages but provides a more durable and more easily serviceable liner structure. In accordance with the present invention, the upstream end of throat insert 24 is stationarily but flexibly connected to shell 22 in the manner best illustrated in FIGS. 2, 3, 5 and 6. As shown therein, a plurality of axially extending slots 32 are formed at spaced locations along the outer periphery of the upstream end (the left-hand side is viewed in FIG. 2) of insert 24. Each adjacent pair of slots 32 defines a distinct flexible finger 34 whose shape is best illustrated in FIGS. 5 and 6. Each finger 34 is connected to outer shell 22 by a respective fastening means such as, for example, a plug weld 36. Plug welds 36 are formed by welding a plurality of openings formed in the outer shell 22 which are aligned with an equal number of fingers 34. See FIG. 5.

Slots 32 and fingers 34 serve two separate functions; they provide a controlled flow of air from the toroidal space 38 (see FIG. 2) defined between the neck portion 26 and outer shell 22 and they provide a flexible connection between the upstream portion of insert 24 and shell 22. As best illustrated in FIG. 1, cooling air supplied by compressor 14 enters toroidal space 38 via a plurality of openings 40 formed in shell 22. The plurality of openings 40 permit unrestricted flow of air into the toroidal space 38 for cooling the throat insert 24 and providing combustion air to the combustor when desired. Overall cooling of the cylindrical outer shell 22 may be provided in a conventional manner with either louvers or slots as described in U.S. Pat. No. 3,777,484 to Dibelius and Schiefer or U.S. Pat. No. 3,728,039 to Corrigan and Plennums. The air in toroidal space 38 migrates to upstream chamber 28 in a controlled manner by passing through slots 32 as shown by arrow 42 in FIG. 5. This migration serves both to cool fingers 34 and to supply additional cooling air to the walls of chamber 28.

The throat insert 24 is mounted within the shell 22 by integral fingers 34 which provide a controlled mount flexibility as a means for diverting liner bending loads on insert 24 directly to the outer shell 22 which is the main structural element of liner 10. Diverting the bending loads from the throat insert 24 to the outer shell 22 reduces stress on insert 24 and thereby increases the life of the insert. Fingers 34 also introduce controlled inner wall flexibility which further reduces stress induced by the differential thermal expansion between outer shell 22 and insert 24.

While the upstream end of insert 24 is stationarily coupled to shell 22, the downstream end is resiliently, slidably coupled by a plurality of spring loaded fingers 44. The particular structure of fingers 44 and the manner in which they cooperate with shell 22 and insert 24 may best be understood with reference to FIGS. 7–10.

Figure 7:
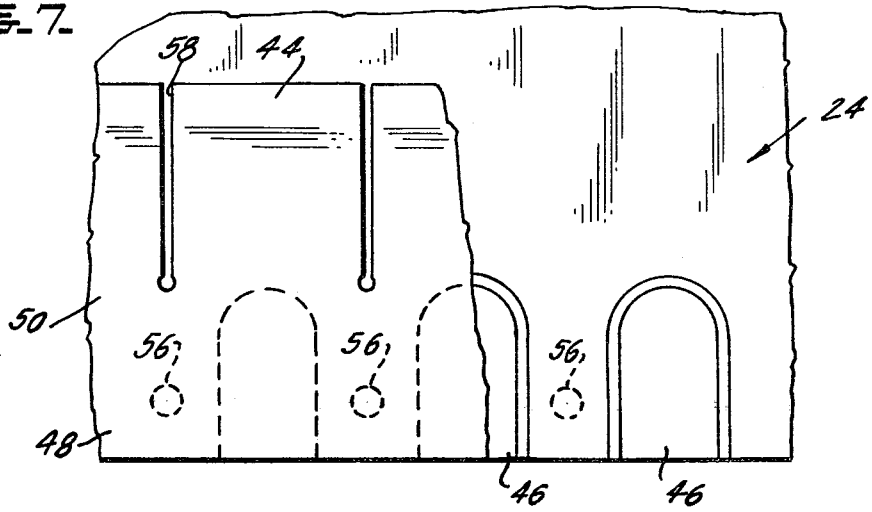
FIG. 7 is a detailed view illustrating the connection between the downstream end of the throat insert and the air seal taken along lines 7—7 of FIG. 8.
Figure 8:
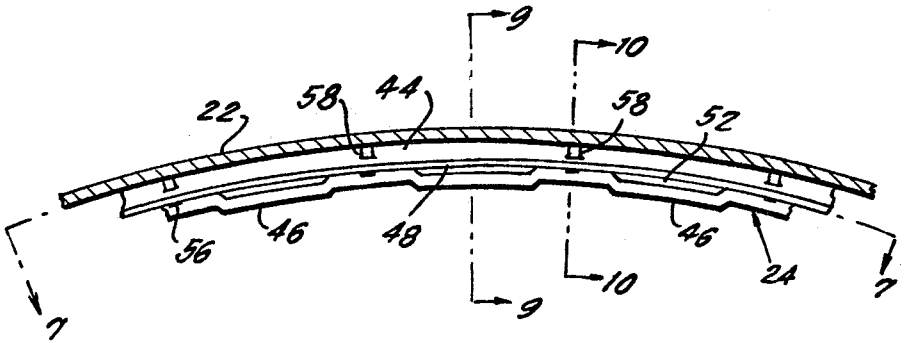
FIG. 8 is an end view, partially in section, taken along lines 8—8 of FIG. 2 and illustrating the connection between the downstream end of the throat insert and the outer casing of the liner assembly.

As best viewed in FIGS. 7 and 8, a plurality of convolutions 46 are formed at circumferentially spaced locations along the outer periphery of the downstream end of insert 24. The convolutions 46 cooperate with the base end 48 of an air seal 50 to form a plurality of air flow metering passages 52 which permit air located in the toroidal space 38 to migrate to the downstream chamber 30 and serves to cool both the downstream end of insert 24 and fingers 44. The migration of air into passges 52 is indicated by arrow 54 in FIG. 9.

Figure 10:
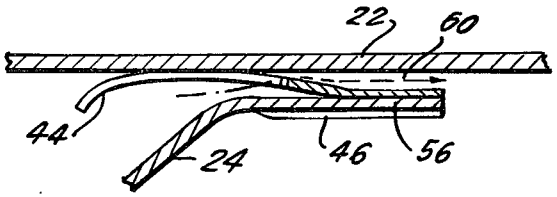
FIG. 10 is a detailed view, partially in section, taken along lines 10—10 of FIG. 8.
Figure 9:
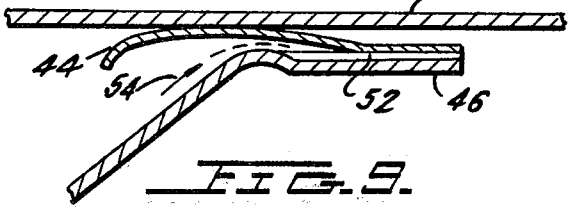
FIG. 9 is detailed view, partially in section, taken along lines 9—9 of FIG. 8.

Air seal 50 is preferably formed of a continuous metal plate which is rolled into a circle and connected to insert 24 for example, by a plurality of spot welds 56. A plurality of slots 58 are formed in the distal end of seal 50 so as to define a plurality of fingers 44 whose shape is best illustrated in FIGS. 7 and 10. The location of slots 58 preferably align with spot welds 56 so that cooling air can pass through each slot and over its associated weld 56 as best illustrated by arrow 60 in FIG. 10. This serves to keep weld 56 relatively cool and reduces the likelihood that the weld will deteriorate.

When insert 24 is placed within outer shell 22, fingers 44 are compressed radially and are placed in a prestressed condition. This produces a controlled preload at each spring finger 44 and provides several benefits. Initially, preloading avoids joint gaps that would otherwise permit gross, uncontrolled air leakage. Additionally, preloading introduces Coulomb damping as a means of attenuating the mechanical vibration normally induced in the insert 24 by normal combustion operation. Since the downstream end of insert 24 is unrestrained except for the preloaded stresses in fingers 44 the downstream end of insert 24 is capable of radial deflection and/or axial motion which is impeded only by the friction induced by the preloading. As a result, joint mobility, required to lessen stresses induced by differential thermal expansion between insert 24 and shell 22 is provided. Finally, the relative mobility between the downstream end of insert 24 and shell 22 facilitates the servicing of liner assembly 10 since insert 24 may be slid axially with respect to shell 22 once the plug welds 36 located in the upstream end of insert 24 have been drilled out or otherwise removed.

This procedure may best be understood with reference to FIG. 1. If insert 24 has been damaged or has otherwise deteriorated to an unacceptable state, it can be removed from shell 22 as follows. Initially, combustion chamber cover 61 is removed from combustor 12 along with nozzles 62. At this point, the entire liner 10 is removed from combustor 12 by withdrawing it axially to the left as viewed in FIG. 1. After the liner assembly 10 has been removed from combustor 12, plug welds 36 are quickly and simply removed by drilling or any other suitable process. At this point, insert 24 is slid out of shell 22 by moving it axially to the right as viewed in FIG. 1. At that point, a new liner insert may be slid into shell 22 and reattached by appropriate plug welds. If for any reason the outer shell 22 deteriorates before the insert 24, the shell 22 may be replaced by a similar process.

As described above, several air passage openings are formed in liner assembly 10 for the purpose of supplying air to combustor 12 and for the purpose of cooling various portions of liner assembly 10. Obviously, other cooling arrangements such as water cooling, closed system, steam film cooling and conventional air film cooling may also be used if desired.

In summary, the combustion liner and throat insert of the present invention enhance the mechanical integrity of the combustor by the inclusion of a double-wall structure which improves durability and facilitates servicing. Additionally, the double-wall structure provides structural damping, cooling and sealing for the throat insert.

The present invention may be embodied in other specific forms without departing from the spirit or essential attributes thereof. For example, throughout the specification reference has been made to the upstream and downstream ends of the insert, however those skilled in the art can appreciate that these ends can interchange with only minor modifications without departing from the spirit and scope of the invention. Accordingly, reference should be made to the appended claims, rather than to the foregoing specification as indicating the scope of the invention.

What is claimed is:

1. A liner assembly for a combustor used in connection with a gas turbine, said liner assembly comprising:

an outer structural shell;

a separate throat insert flexibly coupled to and situated in said outer shell;

said throat insert including a reduced throat section effective to divide said outer shell into an upstream chamber and a downstream chamber;

a plurality of upstream fingers defined by a plurality of slots in an upstream end of said throat insert;

means for connecting each of said upstream fingers to said outer shell; and a plurality of downstream fingers on a downstream end of said throat insert, said downstream fingers including means for coupling said downstream end to said outer shell.

2. A liner assembly according to claim 1 wherein at least one of said upstream or said downstream fingers is rigidly connected to said outer shell.

3. A liner assembly according to claim 2 wherein the other of said upstream or downstream fingers includes slidable connection to said outer shell.

4. A liner assembly according to claim 1 wherein said upstream and downstream fingers are effective to flexibly couple said throat insert to said outer shell.

5. A liner assembly according to claim 1 wherein said means for coupling said downstream fingers includes slidable means for coupling to said outer shell.

6. A liner assembly according to claim 5 wherein said slidable means includes a pre-stressed condition in said downstream fingers effective to bias said downstream fingers outward against said outer shell.

7. A liner assembly according to claim 6 wherein all of said downstream fingers are integrally formed.

8. A liner assembly according to claim 7 wherein each of said downstream fingers is part of a continuous metal sheet.

9. A liner assembly according to claim 8 wherein each of said downstream fingers is defined by respective adjacent slots formed in said continuous metal sheet.

10. A liner assembly according to claim 9 wherein said continuous metal sheet is welded to said throat insert by a plurality of welds.

11. A liner assembly according to claim 10 wherein said slots are aligned with said welds such that a supply of cooling air can pass through said slots and over said welds.

12. A liner assembly according to claim 9 wherein a downstream end of said throat insert includes a plurality of convolutions formed therein and said metal sheet and said fingers cooperate with said convolutions to define a plurality of air flow metering passages.

13. A liner assembly according to claim 11 wherein said throat insert is effective to form a toroidal space between said throat insert and said outer shell and said slots in said continuous metal sheet are effective to pass cooling air from said toroidal space into said downstream chamber.

14. A liner assembly according to claim 12 wherein said throat insert is effective to form a toroidal space between said throat insert and said outer shell and said slots in said continuous metal sheet are effective to pass cooling air from said toroidal space into said downstream chamber via said air metering passages.

15. A liner assembly according to claim 1 wherein said throat insert is effective to form a toroidal space between said throat insert and said outer shell and said plurality of slots in said upstream end being effective to pass cooling air from said toroidal space to said upstream chamber.

* * * * *